US008657608B2

(12) United States Patent
Tsai et al.

(10) Patent No.: US 8,657,608 B2
(45) Date of Patent: Feb. 25, 2014

(54) ELECTRICAL CONNECTOR

(75) Inventors: Shang Ju Tsai, Keelung (TW); Yan Xian Yuan, Guangzhou (CN); Yao Li, Guangzhou (CN)

(73) Assignee: Lotes Co., Ltd., Keelung (TW)

( * ) Notice: Subject to any disclaimer, the term of this patent is extended or adjusted under 35 U.S.C. 154(b) by 56 days.

(21) Appl. No.: 13/614,548

(22) Filed: Sep. 13, 2012

(65) Prior Publication Data

US 2014/0024258 A1 Jan. 23, 2014

(30) Foreign Application Priority Data

Jul. 18, 2012 (CN) ..... 2012 2 0346790 U

(51) Int. Cl.
*H01R 12/00* (2006.01)

(52) U.S. Cl.
USPC ..... 439/63; 439/581

(58) Field of Classification Search
CPC ..... H01R 24/50
USPC ..... 439/63, 581
See application file for complete search history.

(56) References Cited

U.S. PATENT DOCUMENTS 6,068,499 A * 5/2000 Kuriyama et al. ..... 439/188
6,074,217 A * 6/2000 Maruyama et al. ..... 439/63
6,393,698 B1 * 5/2002 Kuriyama et al. ..... 29/883
6,431,915 B1 * 8/2002 Ko ..... 439/607.41
6,474,995 B1 * 11/2002 Wu ..... 439/63
6,488,512 B2 * 12/2002 Gonzales ..... 439/63
6,533,610 B1 * 3/2003 Dai et al. ..... 439/581
6,607,400 B1 * 8/2003 Ko ..... 439/581
6,761,571 B2 * 7/2004 Hida ..... 439/188
6,843,673 B1 * 1/2005 Liu et al. ..... 439/188
6,902,408 B2 * 6/2005 Yamane ..... 439/63
6,932,615 B1 * 8/2005 Yeo ..... 439/63
6,974,340 B2 * 12/2005 Zech et al. ..... 439/188
7,118,383 B2 * 10/2006 Nagata et al. ..... 439/63
7,217,137 B1 * 5/2007 Nakagawa ..... 439/63
7,334,327 B1 * 2/2008 Chen et al. ..... 29/876
7,367,811 B2 * 5/2008 Nagata ..... 439/63
7,484,965 B2 * 2/2009 Chien et al. ..... 439/63
7,632,123 B2 * 12/2009 Nakagawa ..... 439/188
7,648,394 B2 * 1/2010 Yotsutani ..... 439/581
7,651,334 B2 * 1/2010 Zhang ..... 439/63
7,651,335 B2 * 1/2010 Chen ..... 439/63
7,699,652 B2 * 4/2010 Yotsutani ..... 439/581
7,794,253 B2 * 9/2010 Wang et al. ..... 439/188
7,891,979 B2 * 2/2011 Chien et al. ..... 439/63
7,976,315 B2 * 7/2011 Zuinen et al. ..... 439/63
7,985,076 B2 * 7/2011 Zuinen et al. ..... 439/63
7,993,144 B2 * 8/2011 Hu et al. ..... 439/63

(Continued)

*Primary Examiner* — Ross Gushi
(74) *Attorney, Agent, or Firm* — Morris Manning & Martin LLP; Tim Tingkang Xia, Esq.

(57) ABSTRACT

An electrical connector includes a grounding terminal, a signal terminal and an insulating body. The grounding terminal has an annular body. The annular body is formed by curling and has a seam. The seam extends to form at least one grounding pin. The signal terminal has a base located below the annular body. The base has one end provided with a soldering portion and the other end extending upwards to form a contact portion in the center of the annular body, and the base does not overlap a projection of the seam on a plane where the base locates. The insulating body wrapps the grounding terminal and the signal terminal, and the grounding pin and the soldering portion protrude out of the insulating body.

10 Claims, 5 Drawing Sheets

(56) References Cited

U.S. PATENT DOCUMENTS

| | | | | |
|---|---|---|---|---|
| 8,038,450 | B2 * | 10/2011 | Nakagawa | 439/63 |
| 8,066,516 | B2 * | 11/2011 | Hoshiba et al. | 439/63 |
| 8,087,940 | B1 * | 1/2012 | Lee et al. | 439/63 |
| 8,262,398 | B2 * | 9/2012 | Chen | 439/188 |
| 8,414,306 | B2 * | 4/2013 | Tagawa et al. | 439/63 |
| 8,444,422 | B2 * | 5/2013 | Lin | 439/63 |
| 2001/0051448 | A1 * | 12/2001 | Gonzales | 439/63 |
| 2003/0129858 | A1 * | 7/2003 | Huang et al. | 439/63 |
| 2004/0102061 | A1 * | 5/2004 | Watanabe | 439/63 |
| 2004/0137764 | A1 * | 7/2004 | Yamane | 439/63 |
| 2005/0159022 | A1 * | 7/2005 | Nagata | 439/63 |
| 2006/0009075 | A1 * | 1/2006 | Nagata et al. | 439/581 |
| 2006/0024985 | A1 * | 2/2006 | Nagata et al. | 439/63 |
| 2008/0034583 | A1 * | 2/2008 | Chen et al. | 29/876 |
| 2008/0254676 | A1 * | 10/2008 | Chien et al. | 439/581 |
| 2009/0117779 | A1 * | 5/2009 | Zhang | 439/581 |
| 2009/0197432 | A1 * | 8/2009 | Li | 439/63 |
| 2009/0298333 | A1 * | 12/2009 | Yotsutani | 439/581 |
| 2010/0130028 | A1 * | 5/2010 | Hoshiba et al. | 439/63 |
| 2010/0227481 | A1 * | 9/2010 | Liao et al. | 439/63 |
| 2010/0248503 | A1 * | 9/2010 | Kang et al. | 439/63 |

* cited by examiner

ELECTRICAL CONNECTOR

CROSS-REFERENCE TO RELATED APPLICATION

This non-provisional application claims priority under 35 U.S.C. §119(a) on Patent Application No. 201220346790.5 filed in P.R. China on Jul. 18, 2012, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector, and more particularly to a radio frequency (RF) electrical connector.

BACKGROUND OF THE INVENTION

Currently in the industry, a common RF connector, such as one that was disclosed in US Patent Publication No. US2011/0275243, generally includes a grounding terminal and a signal terminal. The grounding terminal comprises an annular body. The annular body is formed by curling and has a seam. Each of two sides of the seam respectively extends to form a grounding pin at a position spaced apart from the seam by a certain distance. The signal terminal has a base. The base has one end provided with a soldering portion and the other end extending upwards to form a contact portion in the center of the annular body. The base is located below the annular body and overlaps a projection of the seam, and the base is disposed between the two grounding pins and coplanar with the grounding pins.

Since the base is located right below the seam, a sufficient clearance needs to be provided between a bottom edge of the annular body and the base in order to prevent contact of the bottom edge of the annular body with the base. The clearance also provides sufficient plastic for wrapping the seam by insert molding, so as to prevent cracking of the seam during insertion of a mating connector or under an external force.

However, as electronic products are currently developing towards light, thin and small structures, it is inevitable that the overall height of the connector needs to be reduced accordingly. Therefore, the thickness of the insulating body will be reduced, and the clearance between the bottom edge of the annular body and the base will be reduced, so that the annular body is very likely to contact the signal terminal, causing short circuit. In addition, the thickness of plastic for wrapping the seam is also reduced, such that cracking or deformation of the seam easily occurs during insertion of a mating connector or under an external force.

Therefore, a heretofore unaddressed need exists in the art to address the aforementioned deficiencies and inadequacies.

SUMMARY OF THE INVENTION

In one aspect, the present invention is directed to an electrical connector that is capable of preventing contact of the grounding terminal with the signal terminal and cracking of the seam.

In one embodiment according to the present invention, an electrical connector includes a grounding terminal, a signal terminal and an insulating body. The ground terminal includes an annular body. The annular body is formed by curling and has a seam. The seam extends to form at least one grounding pin. The signal terminal has a base located below the annular body. The base has one end provided with a soldering portion and the other end extending upwards to form a contact portion in the center of the annular body. The base does not overlap a projection of the seam on a plane where the base locates. The insulating body wrapps the grounding terminal and the signal terminal, and the grounding pin and the soldering portion protrude out of the insulating body.

Further, the grounding pin is disposed at the seam.

Further, a side surface of the grounding pin is aligned with a side edge of the seam.

Further, the grounding terminal and the signal terminal are insert molded in the insulating body.

Further, a clearance is provided between the base and a bottom edge of the annular body.

Further, the base is provided with at least one through hole, and the through hole is filled up with the insulating body.

Further, the contact portion has a hollow cavity, at least one recess is located at a position on the contact portion adjacent to the base, and the recess is in communication with the hollow cavity.

Further, two grounding pins are located at two sides of the seam.

Further, the bottom edge of the annular body is provided with at least one retaining foot, and the retaining foot is buried in the insulating body.

Further, the bottom edge of the annular body is provided with a notch, and the notch is disposed corresponding to the base.

As compared with the related art, the present invention, among other things, has the following advantages and beneficial effects.

The annular body of the grounding terminal is formed by curling and has a seam, the bottom edge of the annular body extends to form at least one grounding pin, the signal terminal has a base located below the annular body, and the base does not overlap the projection of the seam on a plane where the base locates, so that in the case where the overall height of the connector is reduced, it can ensure that a great thickness is buried in the insulating body at the seam, and that a great clearance is provided between the base and the annular body located above the base, thereby preventing contact of the grounding terminal with the signal terminal.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment, and wherein.

DETAILED DESCRIPTION OF THE INVENTION

Figure 1:
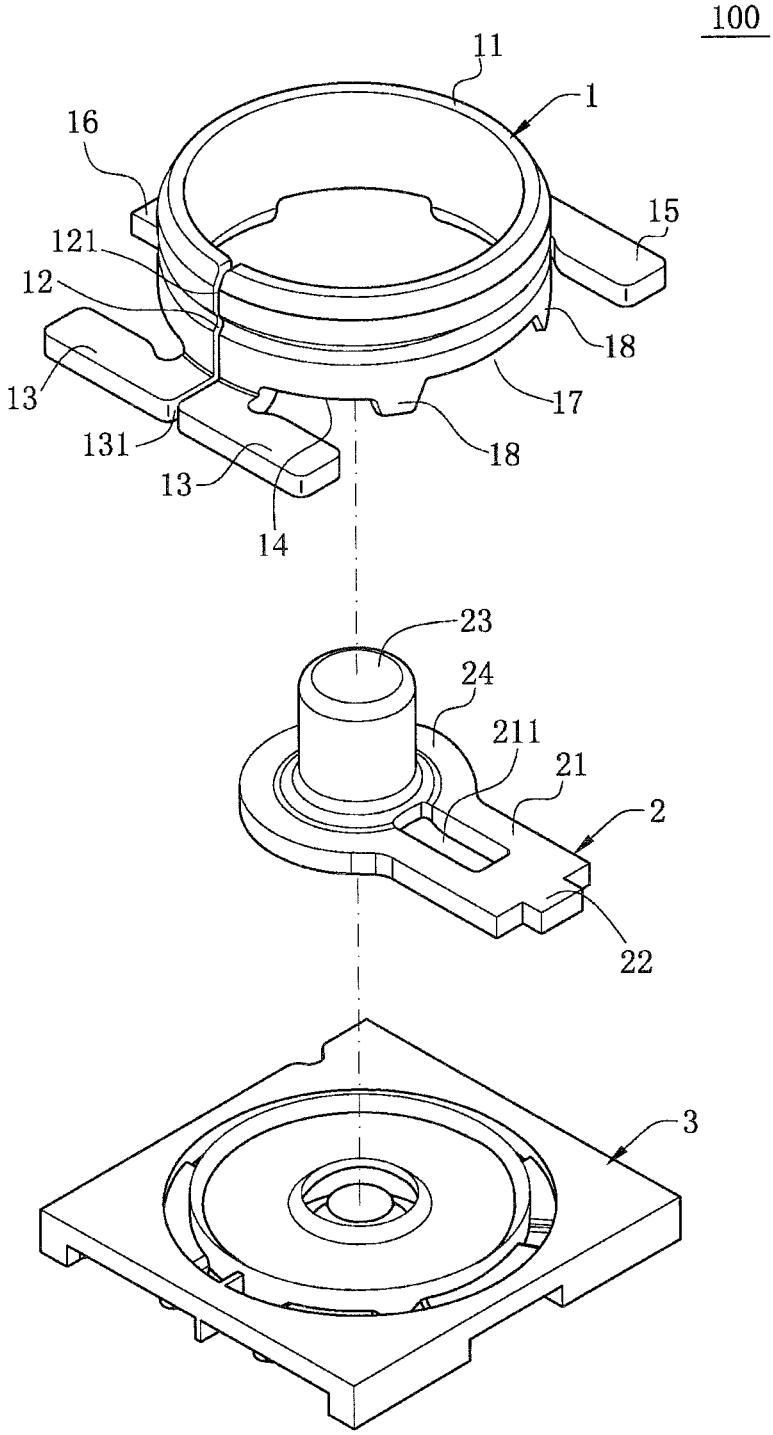
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

Referring to FIG. 1, an electrical connector 100 of the present invention includes a grounding terminal 1, a signal terminal 2, and an insulating body 3 wrapping the grounding terminal 1 and the signal terminal 2.

Figure 2:
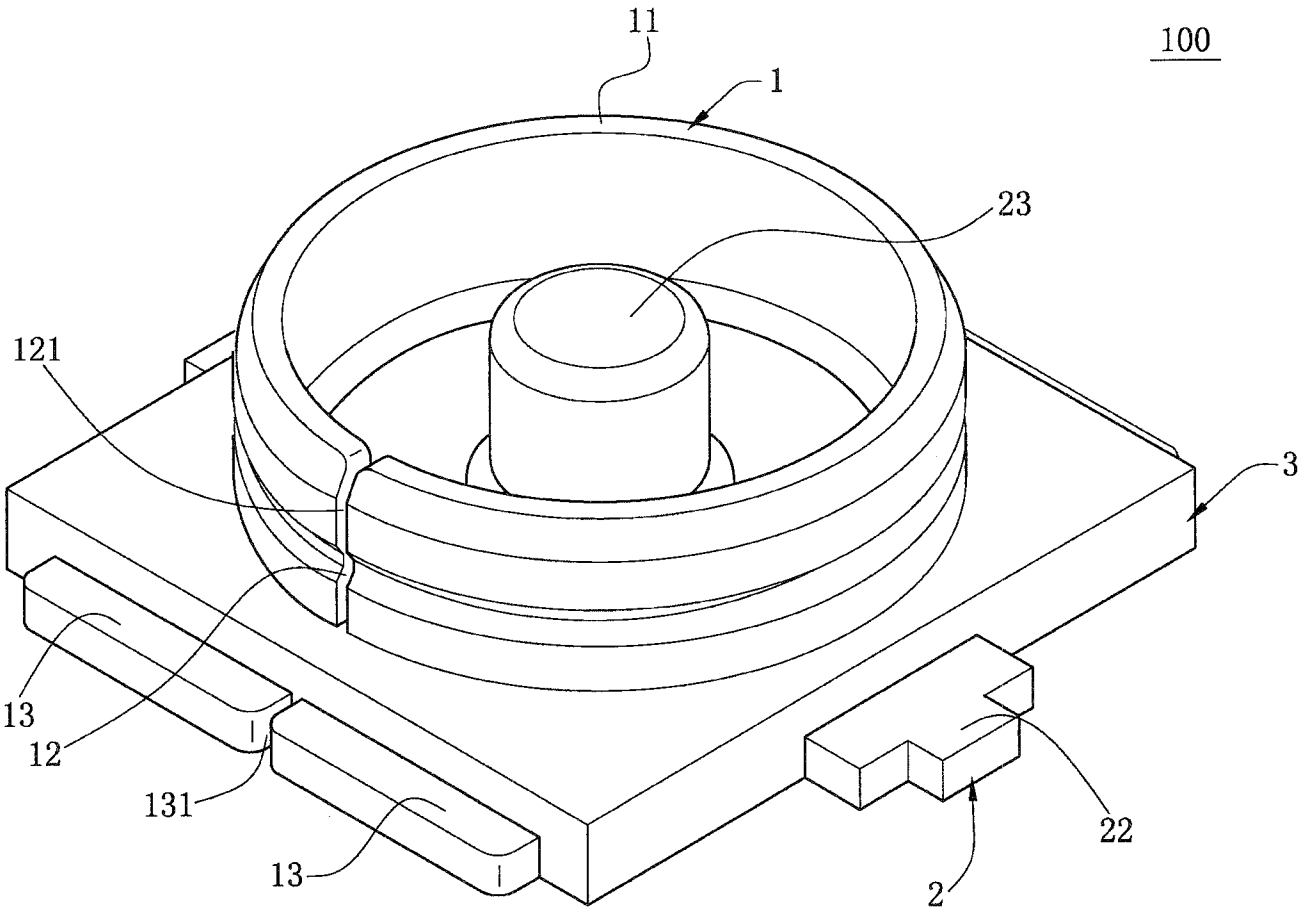
FIG. 2 is a schematic three-dimensional assembled view of the electrical connector according to the embodiment of the present invention.
Figure 3:
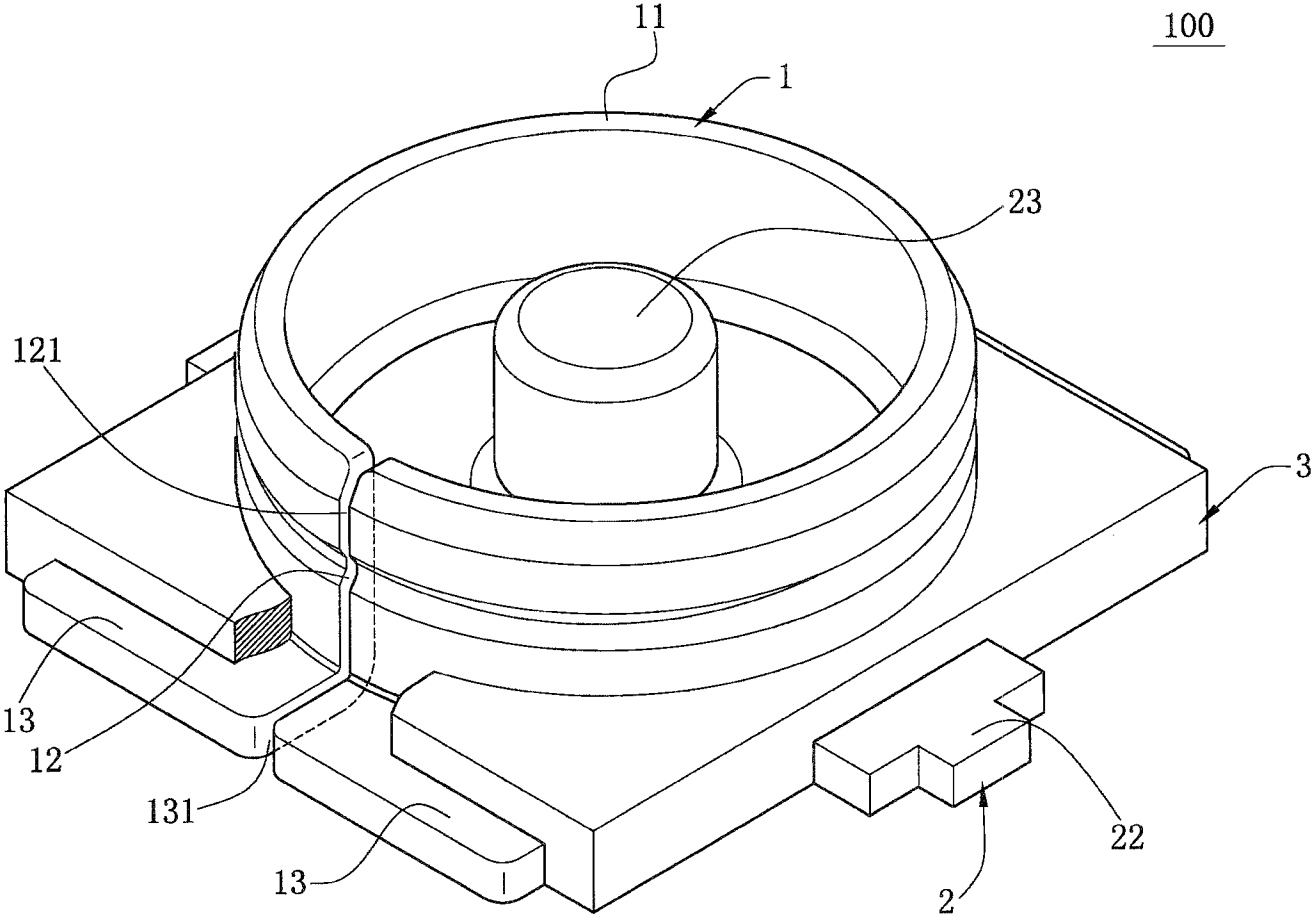
FIG. 3 is a three-dimensional partial sectional view of the electrical connector according to the embodiment of the present invention.

As shown in FIGS. 1-3, the grounding terminal 1 includes an annular body 11. The annular body 11 is formed by curling a metal plate (not shown), with a seam 12 formed between two ends thereof. The annular body 11 is bent laterally at the seam 12 and extends to form two first grounding pins 13, and the first grounding pins 13 are located at two sides of the seam 12, respectively. In this embodiment, a side surface 131 of each of the first grounding pin 13 is aligned with a side edge 121 of the seam 12. In other embodiments, the first grounding pin 13 is located close to the seam 12. The annular body 11 further includes a second grounding pin 15 bent laterally and extending from a bottom edge 14 of the annular body 11, and disposed opposite to the first grounding pins 13. In addition, the annular body 11 includes a connecting portion 16 bent laterally and extending from the bottom edge 14 of the annular body 11, and located between one of the first grounding pins 13 and the second grounding pin 15. The annular body 11 is further provided with a notch 17 recessed upwards from the bottom edge 14, located between the other one of the first grounding pins 13 and the second grounding pin 15, and opposite to the connecting portion 16. Two sides of the notch 17 are respectively provided with a retaining foot 18. In another embodiment, the number of the retaining foot 18 may be one or more, and the retaining foot 18 may also be disposed at other positions. In other embodiments, the retaining foot 18 is disposed in a laterally bent manner.

Figure 4:
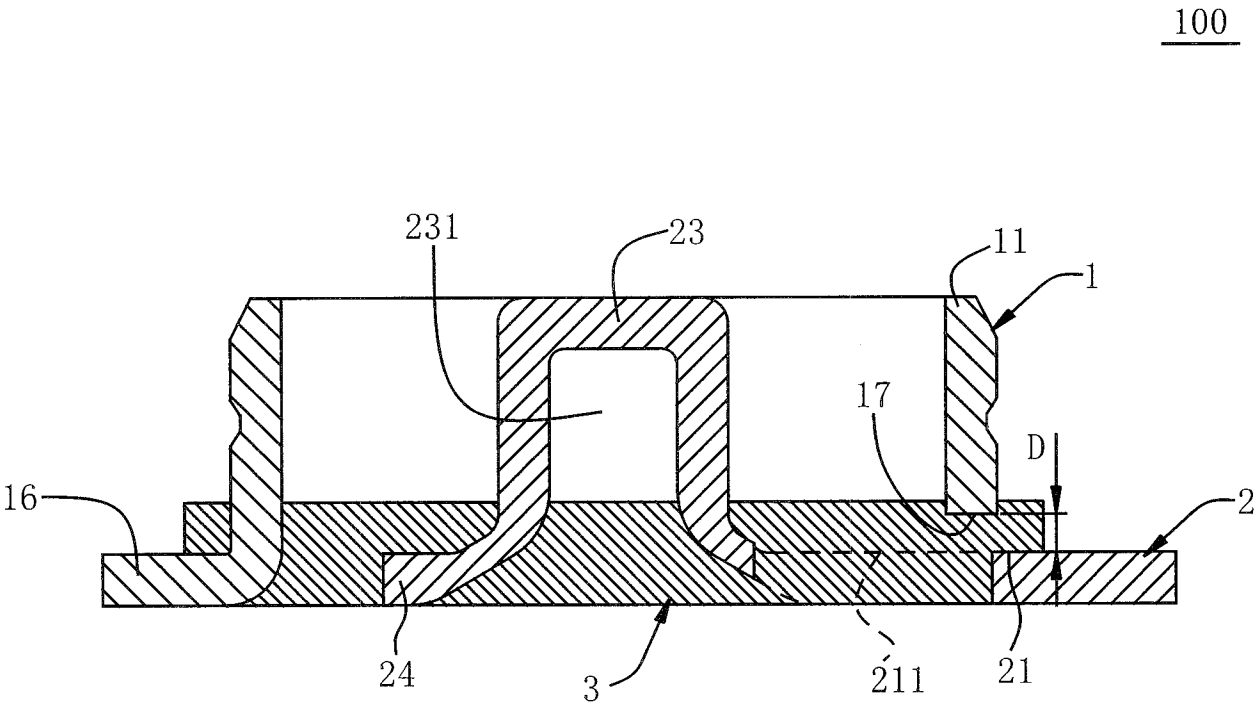
FIG. 4 is a sectional view of the electrical connector according to the embodiment of the present invention.
Figure 5:
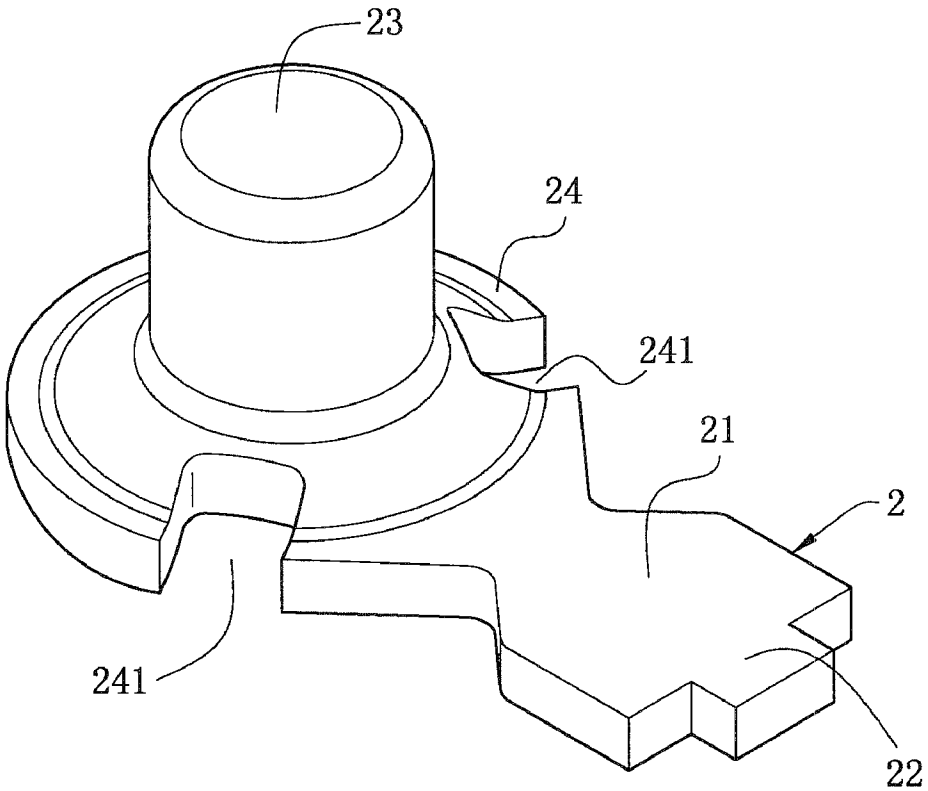
FIG. 5 is a schematic view of a terminal of another embodiment of the electrical connector according to one embodiment of the present invention.

As shown in FIGS. 1, 4 and 5, the signal terminal 2 has a base 21, which is located below the annular body 11, and does not overlap a projection of the seam 12 on a plane where the base 21 locates. That is, the seam 12 is not located right above the base 21, but is vertically staggered with respect to the base 21. In this embodiment, the base 21 is located right below the notch 17, and is spaced apart from the bottom edge 14 of the annular body 11 by a clearance D. The retaining feet 18 are located at two sides of the base 21. The base 21 has one end provided with a soldering portion 22 and the other end extending upwards to form a contact portion 23 in the center of the annular body 11. The contact portion 23 has a hollow cavity 231, and an arc-shaped portion 24 is formed at a junction between the contact portion 23 and the base 21. In this embodiment, the base 21 is provided with a through hole 211, and the through hole 211 is in communication with the hollow cavity 231 as seen in FIG. 4. In another embodiment as shown in FIG. 5, the arc-shaped portion 24 is provided with two recesses 241 adjacent to the base 21, and the recesses 241 are in communication with the hollow cavity 231.

As shown in FIG. 2, the insulating body 3 is formed at the bottom of the grounding terminal 1 and the signal terminal 2 by insert molding. The insulating body 3 partially wraps the grounding terminal 1 and the signal terminal 2, and the grounding pin and the soldering portion 22 are exposed out of the insulating body 3 to be soldered to a circuit board (not shown).

As shown in FIGS. 1-3, during assembly, first, the grounding terminal 1 and the signal terminal 2 are positioned, such that the contact portion 23 is placed right in the center of the annular body 11, the base 21 is located right below the notch 17, and the soldering portion 22 is coplanar with the grounding pins 13, 15. Then, the insulating body 3 is insert molded at the bottom of the grounding terminal 1 and the signal terminal 2, so that the insulating body 3 partially wraps the grounding terminal 1 and the signal terminal 2. As shown in FIG. 4, in this embodiment, the liquid insulating body 3 fills up the through hole 211, and flows along the through hole 211 into the hollow cavity 231 to partially fill the hollow cavity 231. As shown in FIG. 5, in another embodiment, the liquid insulating body 3 enters the recesses 241, and flows along the recesses 241 into the hollow cavity 231 to partially fill the hollow cavity 231, so as to better retain the signal terminal 2 in the insulating body 3.

As shown in FIGS. 1, 3 and 4, since the seam 12 extends to form the first grounding pins 13, the first grounding pins 13 are buried in the insulating body 3 by a great height, and the height of the annular body 11 at the seam 12 buried in the insulating body 3 is the same as the thickness of the insulating body 3, the seam 12 can be stably retained in the insulating body 3, so that cracking of the seam 12 will not occur during insertion of a mating connector or under an external force. Meanwhile, a sufficient distance is maintained between the bottom edge 14 of the annular body 11 at the notch 17 and the base 21, thereby preventing contact of the grounding terminal 1 with the signal terminal 2. In addition, the annular body 11 at the notch 17 is buried in the insulating body 3 by a small depth, while the retaining feet 18 can enhance the retaining force, thereby achieving a desirable retaining effect between the whole annular body 11 and the insulating body 3.

Based on the above, the electrical connector 100 of the present invention, among other things, has the following advantages and beneficial effects.

(1) Since the base 21 does not overlap the projection of the seam 12 on a plane where the base 21 locates, the seam 12 extends to form the grounding pins 13, and the height of the grounding pins 13 and the seam 12 buried in the insulating body 3 is equal to the thickness of the insulating body 3, the seam 12 can be stably retained in the insulating body 3, so that cracking or deformation of the seam 12 will not occur during insertion of a mating connector or under an external force.

(2) The configuration of the notch 17 provides a sufficient clearance D between the base 21 and the bottom edge 14 of the annular body 11 located above the base 21, thereby preventing contact of the grounding terminal 1 with the signal terminal 2.

(3) Since the retaining feet 18 are buried in the insulating body 3, the retaining force between the grounding terminal 1 and the insulating body 3 can be enhanced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a grounding terminal having an annular body, wherein the annular body is curled to form a seam, and the seam extends to form at least one grounding pin;

a signal terminal having a base located below the annular body, wherein the base has one end provided with a soldering portion and the other end extending upwards to form a contact portion in the center of the annular body, and the base does not overlap a projection of the seam on a plane where the base locates; and an insulating body, configured to retain the grounding terminal and the signal terminal.

2. The electrical connector according to claim 1, wherein the grounding pin is disposed at the seam.

3. The electrical connector according to claim 2, wherein a side surface of the grounding pin is aligned with a side edge of the seam.

4. The electrical connector according to claim 1, wherein the grounding terminal and the signal terminal are insert molded in the insulating body.

5. The electrical connector according to claim 1, wherein a clearance is provided between the base and a bottom edge of the annular body.

6. The electrical connector according to claim 1, wherein the base is provided with at least one through hole, and the through hole is filled up with the insulating body.

7. The electrical connector according to claim 1, wherein the contact portion has a hollow cavity, at least one recess is located at a position on the contact portion adjacent to the base, and the recess is in communication with the hollow cavity.

8. The electrical connector according to claim 1, wherein two grounding pins are located at two sides of the seam.

9. The electrical connector according to claim 1, wherein the bottom edge of the annular body is provided with at least one retaining foot, and the retaining foot is buried in the insulating body.

10. The electrical connector according to claim 1, wherein the bottom edge of the annular body is provided with a notch, and the notch is disposed corresponding to the base.

* * * * *